US007926570B1

(12) United States Patent
Blanchard, Jr. et al.

(10) Patent No.: US 7,926,570 B1
(45) **Date of Patent: *Apr. 19, 2011**

(54) METHOD AND APPARATUS FOR PREVENTING SPILLAGE OR LOSS OF DRILL FLUIDS

(75) Inventors: Richard Blanchard, Jr., Metairie, LA (US); Sandra Remedies, La Place, LA (US); John Rucker, Sr., La Place, LA (US)

(73) Assignee: Hudson Services, Inc., LaPlace, LA (US)

( * ) Notice: Subject to any disclaimer, the term of this patent is extended or adjusted under 35 U.S.C. 154(b) by 11 days.

This patent is subject to a terminal disclaimer.

(21) Appl. No.: 12/726,380

(22) Filed: Mar. 18, 2010

Related U.S. Application Data

(63) Continuation of application No. 12/346,267, filed on Dec. 30, 2008, now Pat. No. 7,681,633, and a continuation of application No. 12/123,607, filed on May 20, 2008, now Pat. No. 7,469,747, and a continuation of application No. 11/599,170, filed on Nov. 14, 2006, now Pat. No. 7,373,987, and a continuation of application No. 10/925,827, filed on Aug. 25, 2004, now Pat. No. 7,134,502.

(60) Provisional application No. 60/498,215, filed on Aug. 27, 2003.

(51) Int. Cl.
*E21B 29/08* (2006.01)
*E21B 43/16* (2006.01)
*E21B 43/112* (2006.01)

(52) U.S. Cl. ..... 166/369; 166/55; 166/81.1; 166/241.6; 166/298; 175/209; 175/217; 408/67

(58) Field of Classification Search ..... None
See application file for complete search history.

(56) References Cited

U.S. PATENT DOCUMENTS

| | | | |
|---|---|---|---|
| 2,353,412 | A | 7/1944 | Miller |
| 2,513,714 | A | 7/1950 | Cordes |
| 2,522,444 | A | 9/1950 | Grable |
| 3,559,739 | A | 2/1971 | Hutchison |
| 4,450,905 | A | 5/1984 | Crain |
| 4,577,702 | A | 3/1986 | Faulkner |
| 5,295,536 | A | 3/1994 | Bode |
| 6,119,772 | A | 9/2000 | Pruet |
| 6,474,418 | B2 | 11/2002 | Miramon |
| 6,595,288 | B2 | 7/2003 | Mosing et al. |

*Primary Examiner* — Zakiya W. Bates
(74) *Attorney, Agent, or Firm* — Garvey, Smith, Nehrbass & North, L.L.C.; Brett A. North

(57) ABSTRACT

A well bore fluid recovery system and method is disclosed for recovering a column of well bore fluid within a stand of casing before cutting the casing. The recovery system relates to a system for preventing fluids from being spilled when casing is being finished for a well bore. After being run the casing must be cut and finished at an appropriate level to install rig equipment such as blow out preventers along with other equipment. However, because of earlier operations, the entire length of casing is typically filled with drilling fluid. Depending on conditions, the length of casing which is to be cut and removed may therefore over a 100-foot (27.4 meter) column of drilling fluid therein. The drilling fluid in this section must be properly drained before the casing is cut and removed.

17 Claims, 7 Drawing Sheets

METHOD AND APPARATUS FOR PREVENTING SPILLAGE OR LOSS OF DRILL FLUIDS

CROSS-REFERENCE TO RELATED APPLICATIONS

This is a continuation of U.S. Ser. No. 12/346,267, filed Dec. 30, 2008 (issuing as U.S. Pat. No. 7,681,633 on Mar. 23, 2010), which was a continuation of U.S. Ser. No. 12/123,607, filed May 20, 2008, (issued as U.S. Pat. No. 7,469,747 on Dec. 30, 2008), which was a continuation of U.S. Ser. No. 11/599,170, filed Nov. 14, 2006, (issued as U.S. Pat. No. 7,373,987 on May 20, 2008), which was a continuation of U.S. Ser. No. 10/925,827, filed Aug. 25, 2004, (issued as U.S. Pat. No. 7,134,502 on Nov. 14, 2006), which claimed priority to U.S. Provisional patent application No. 60/498,215 filed Aug. 27, 2003. Priority of each of these applications is hereby claimed, and each is incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND

The present invention relates generally to drilling fluid recovery and, more specifically, to a system for preventing fluids from being spilled when casing is being finished for a well bore.

The process of drilling subterranean wells to recover oil and gas from reservoirs, consists of boring a hole in the earth down to the petroleum accumulation in the reservoir, and installing pipe from the reservoir to the surface. Casing is a protective pipe liner within the well bore that is cemented in place to insure a pressure-tight connection to the oil and gas reservoir. The casing can be run from the rig floor as it is lowered into the well bore.

When running casing, drilling fluid is added to each section as it is run into the well. This procedure is necessary to prevent the casing from collapsing due to high pressures within the well bore. The drilling fluid acts as a lubricant which facilitates lowering the casing within the well bore.

Drilling fluid, or drilling mud, is very important to the rotary drilling process. Drilling and completion fluids which include fluids such as weighted mud, oil-based fluids, water-based muds and the like are often quite expensive and may frequently cost more than one million dollars per well. It is basically a mixture of water, clay, and special minerals and chemicals and performs many important functions. For example, drilling fluid exerts pressure inside the hole keeping fluids that may be in the formations from entering the hole and perhaps blowing out to the surface. In addition, pressure in the hole forces solid particles of clay in the mud to adhere to the sides of the hole as the drilling fluid circulates upward on its way to the surface. The solids form a thin, impermeable cake on the walls of the hole. If discharged drilling fluids can be hazardous to the environment.

The normal sequence for running casing involves suspending the casing from a top drive or non-top drive (conventional rotary rig) and lowering the casing into the well bore, filling each joint of casing with drilling fluid. The filling of each joint or stand of casing as it is run into the hole is the fill-up process. Lowering the casing into the well bore is facilitated by alternately engaging and disengaging elevator slips and spider slips with the casing string in a stepwise fashion, facilitating the connection of an additional stand of casing to the top of the casing string as it is run into the hole.

Circulation of the fluid is sometimes necessary if resistance is encountered as the casing is lowered into the well bore, preventing the running of the casing string into the hole. This resistance to running the casing into the hole may be due to such factors as drill cuttings, mud cake, or surface tension formed or trapped within the annulus between the well bore and the outside diameter of the casing, or caving of the well bore among other factors. In order to circulate the drilling fluid, the top of the casing must be sealed so that the casing may be pressurized with drilling fluid. Since the casing is under pressure the integrity of the seal is critical to safe operation, and to minimize the loss of expensive drilling fluid. Once the obstruction is removed the casing may be run into the hole as before.

Once the casing reaches the bottom, circulating of the drilling fluid is again necessary to test the surface piping system, to condition the drilling fluid in the hole, and to flush out wall cake and cuttings from the hole. Circulating is continued until at least an amount of drilling fluid equal to the volume of the inside diameter of the casing has been displaced from the casing and well bore. After the drilling fluid has been adequately circulated, the casing may be cemented in place.

After the casing has been run to the desired depth it may be cemented within the well bore. The purpose of cementing the casing is to seal the casing to the well bore formation. In order to cement the casing within the well bore, the assembly to fill and circulate drilling fluid is generally removed from the drilling rig and a cementing head apparatus installed. A special cementing head or plug container is installed on the top portion of the casing being held in place by the elevator. Since the casing and well bore are full of drilling fluid, it is first necessary to inject a spacer fluid to segregated the drilling fluid from the cement to follow. The cementing plugs are used to wipe the inside diameter of the casing and serves to separate the drilling fluid from the cement, as the cement is carried down the casing string. Once the calculated volume of cement required to fill the annulus has been pumped, the top plug is released from the cementing head. Drilling fluid or some other suitable fluid is then pumped in behind the top plug, thus transporting both plugs and the cement contained between the plugs to an apparatus at the bottom of the casing known as a float collar. Once the bottom plug seals the bottom of the casing, the pump pressure increases, which ruptures a diaphragm in the bottom of the plug. This allows the calculated amount of cement to flow from the inside diameter of the casing to a certain level within the annulus being cemented. The annulus is the space within the well bore between the ID of the well bore and the OD of the casing string. When the top plug comes in contact with the bottom plug, pump pressure increases, which indicates that the cementing process has been completed. Once the pressure is lowered inside the casing, a special float collar check valve closes, which keeps cement from flowing from the outside diameter of the casing back into the inside diameter of the casing. At this point the casing is filled with drilling fluid.

After being run the casing must be cut and finished at an appropriate level to install rig equipment such as blow out preventers along with other equipment. However, because of earlier operations, the entire length of casing is typically filled with drilling fluid. Depending on conditions, the length of casing which is to be cut and removed may therefore over a 100-foot (27.4 meter) column of drilling fluid therein. The drilling fluid in this section must be properly drained before the casing is cut and removed.

Prior art systems for removal of the drilling fluid in the casing have consisted of cutting an opening in the casing with a casing cutter, using tarpolines and a pan in an attempt to contain the escaping column of drilling fluid in the casing to be removed. Unfortunately, the prior art systems have been slow (taking up to many hours to drain) and allowing drilling fluid to and escape into the environment creating potential environmental hazards, such as pollution. Additionally, loss of fluids can be costly as the fluids are expensive and must be replaced.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY

The apparatus of the present invention solves the problems confronted in the art in a simple and straightforward manner. What is provided is a fluid recovery system for recovering drilling fluid when cutting casing, such as a recovery system mountable on one or more joints of casing, a receiving tank, and a conduit between the recovery system and the receiving tank. A valve may preferably be provided for controlling flow through the conduit.

The method of the invention may preferably comprise steps such as the steps of mounting a recovery system on a joint of casing, creating a hole in the joint, and collecting the fluid in a receiving tank. The method may further comprise cutting the casing and removing the stand of casing above the cut.

The present invention provides a more efficient operation significantly improving the speed of draining drilling fluid, improving safety, and reducing well fluid loss into the environment.

It is an object of the present invention to provide an improved fluid recovery system.

Another object of the present invention is to have the ability to reduce the time required for setting up the well bore fluid recovery system.

Another object of the present invention is to have the ability to reduce any discharge of drilling fluids.

These and other objects, features, and advantages of the present invention will become apparent from the drawings, the descriptions given herein, and the appended claims. The drawings constitute a part of this specification and include exemplary embodiments to the invention, which may be embodied in various forms.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

It will be understood that such terms as "up," "down," "vertical" and the like are made with reference to the drawings and/or the earth and that the devices may not be arranged in such positions at all times depending on variations in operation, transportation, and the like. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. As well, the relative size of the components may be greatly different from that shown, e.g., a recovery or well bore fluid storage tank 120, discussed below, may typically be much larger than as shown.

Figure 1:
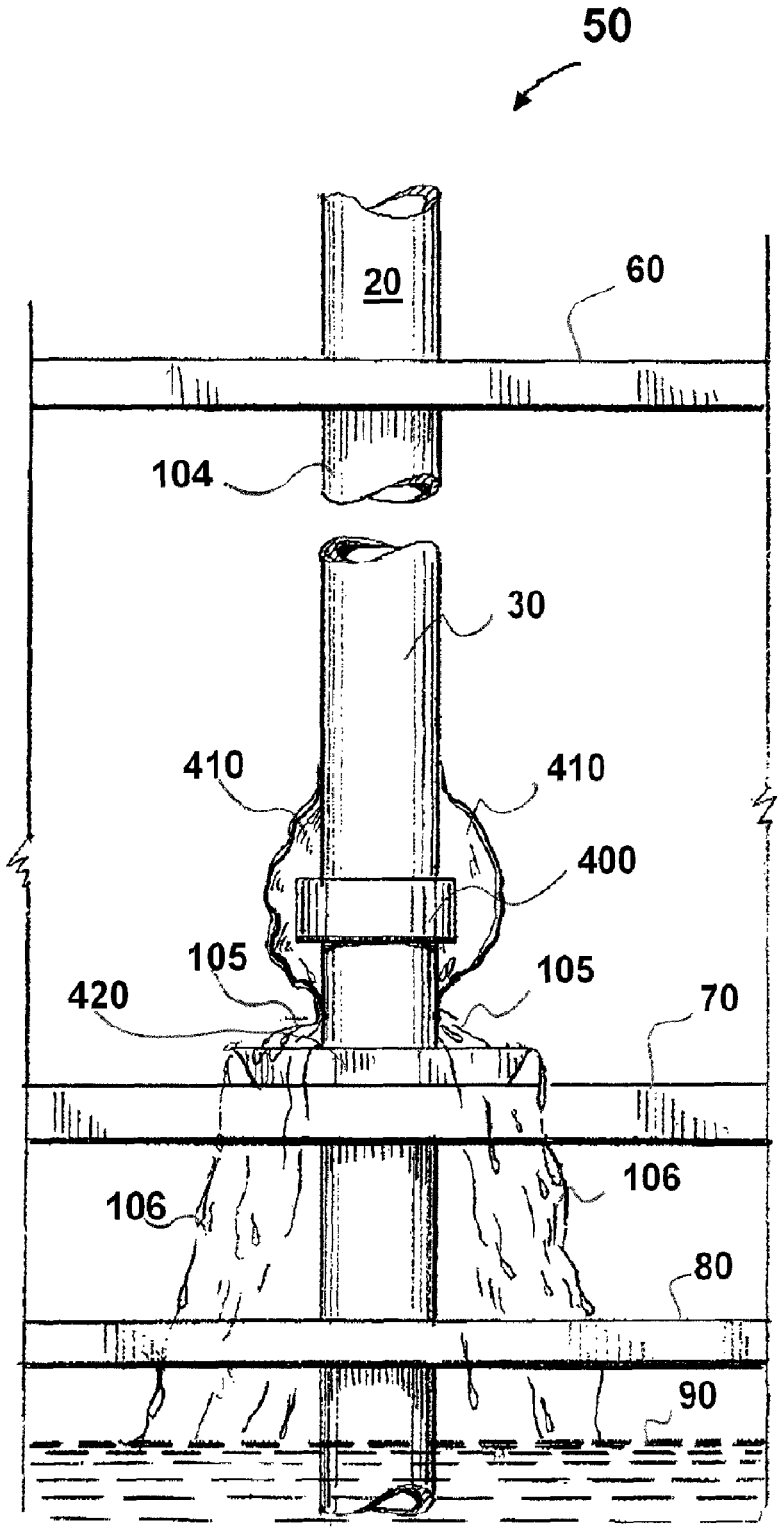
FIG. 1 is a schematic view of the prior art system for recovering drilling fluid.

FIG. 1 is a schematic view of a prior art system for recovering drilling fluid 105. A casing cutter 400 is used to make a cut in casing 20. Column of drilling fluid or mud 104 located in upper section of casing 30 above the cut is then drained in pan 420. Pan 420 can be placed on deck 70. Tarpoline 410 is placed over the cut in an attempt to minimize the loss of drilling fluid 106. Such prior art method is slow, taking up to several hours to drain column of drilling fluid 104 and can require the presence of three to four rig hands. Additionally, there is the risk of spillage of drill fluid 106 which can spray outside of tarpoline 410 or away from pan 420. Furthermore, tarpoline 410 is saturated with drilling fluid and must be properly disposed of.

Figure 2:
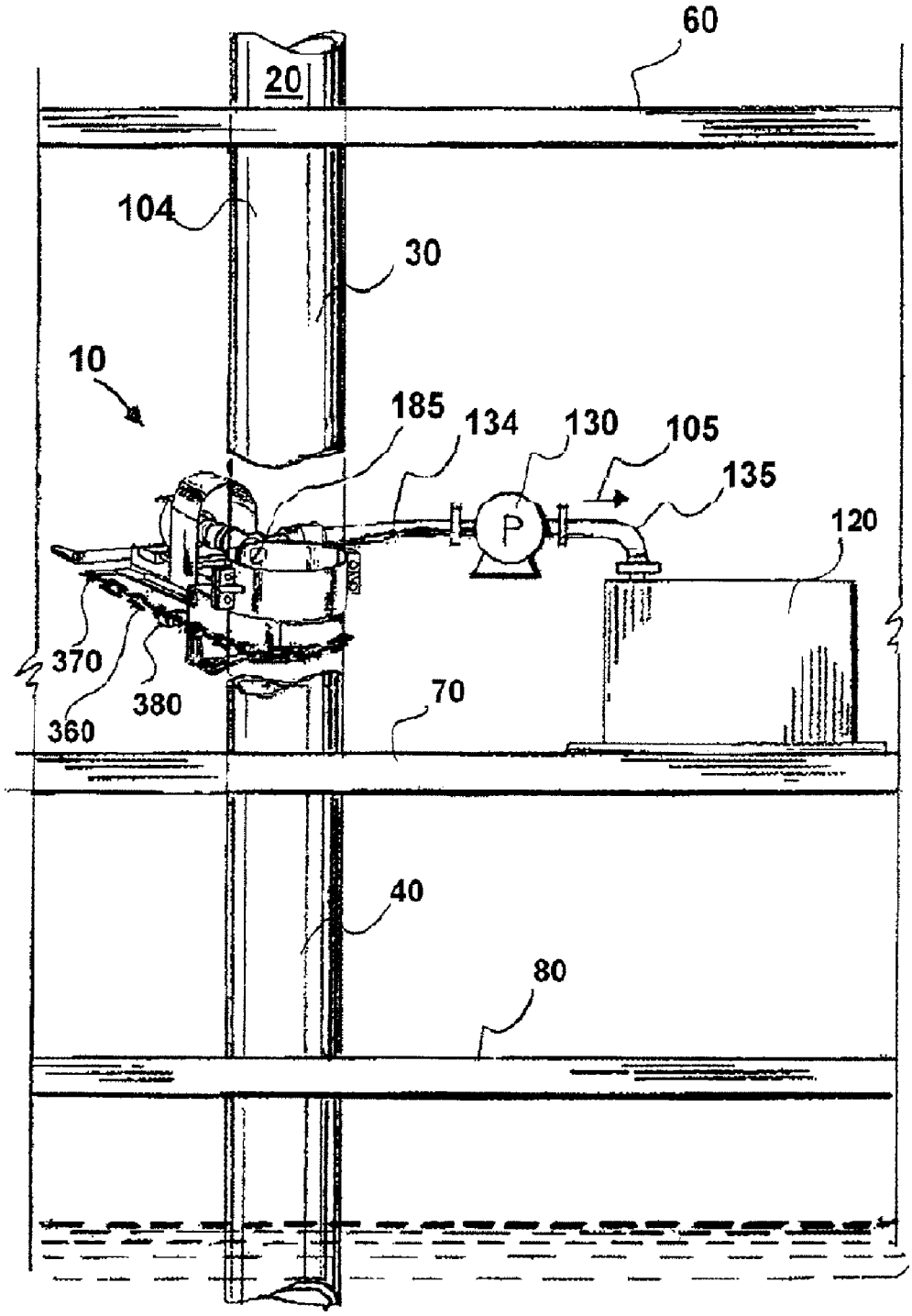
FIG. 2 is a schematic view of a preferred embodiment of the present invention being used to recover drilling fluid.

FIG. 2 is a schematic view of a preferred embodiment of the present invention being used to recover column of drilling fluid or mud 104 in upper section of casing 30. Recovery system 10 is installed on casing 20 and an opening in casing 20 is made through hole 185. Recovery system 10 can be connected to recovery tank 120 and column of drilling fluid or mud 104 is drained through hole 185. Column of drilling fluid or mud 104 is located in upper section of casing 30 and above the hole drilled through hole 185. Pump 130 can be used to increase the rate of drainage of column of drilling fluid or mud 104. Lower section of casing 40 can then be properly finished.

Figure 3:
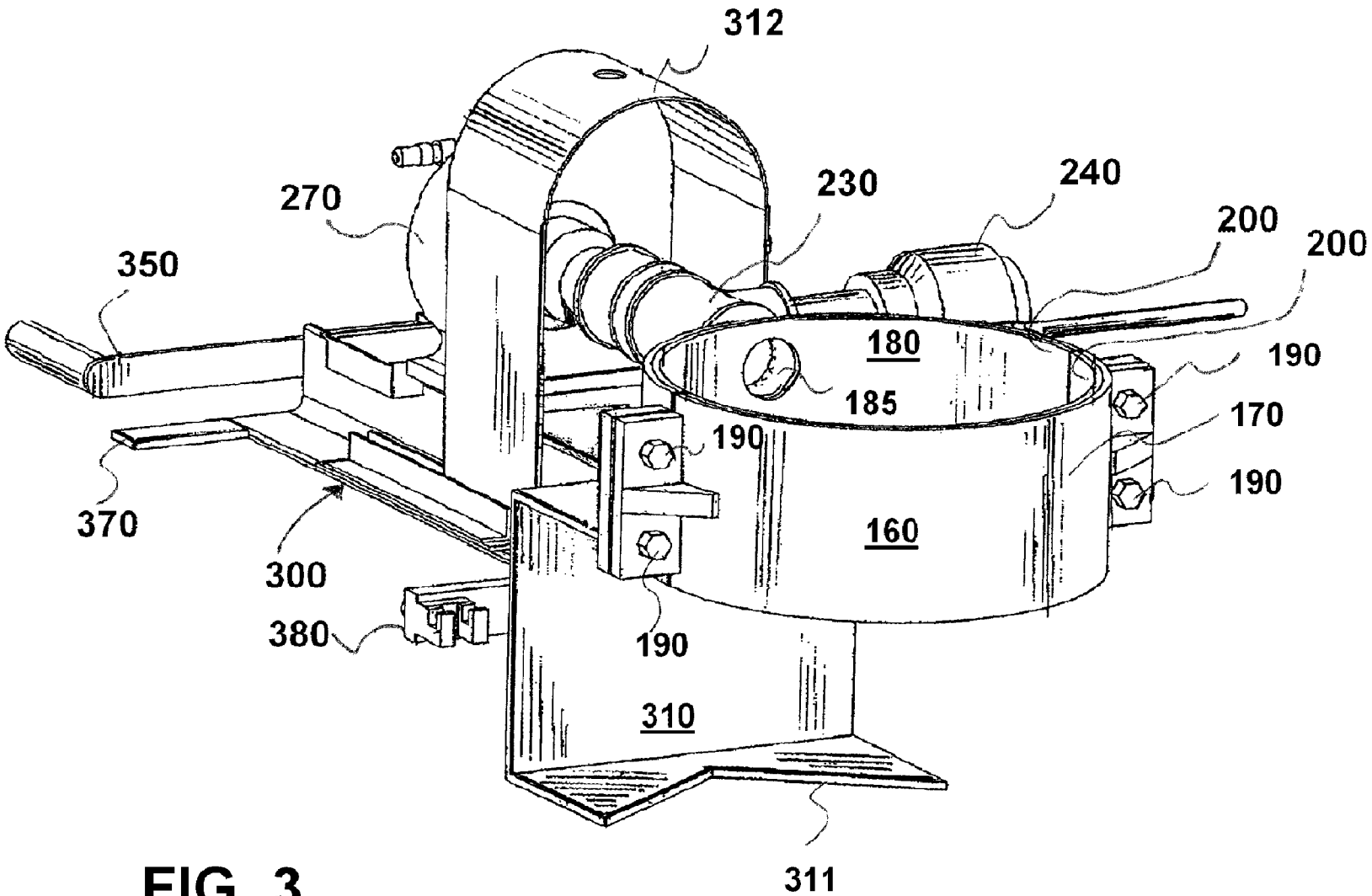
FIG. 3 is a perspective view of the recovery system in FIG. 2.
Figure 4:
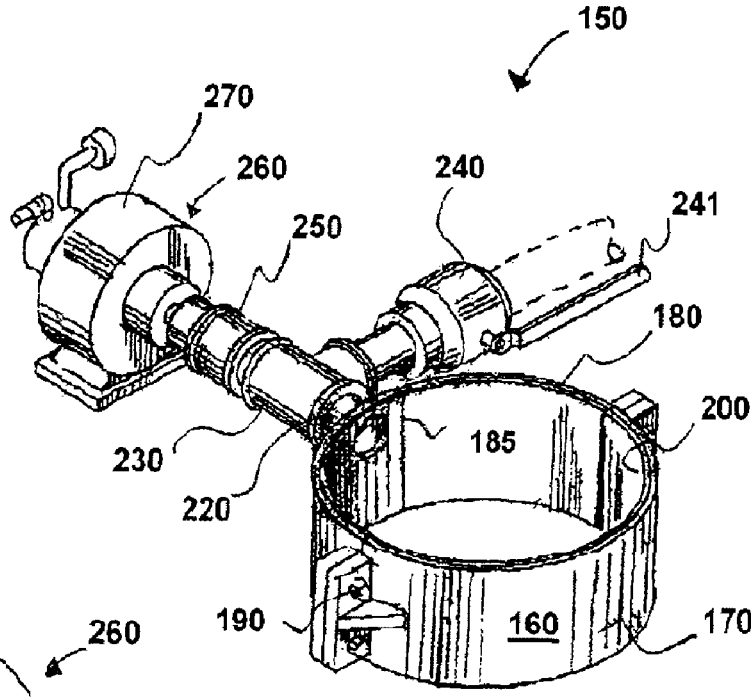
FIG. 4 is a perspective view of the body of the recovery system in FIG. 3.
Figure 5:
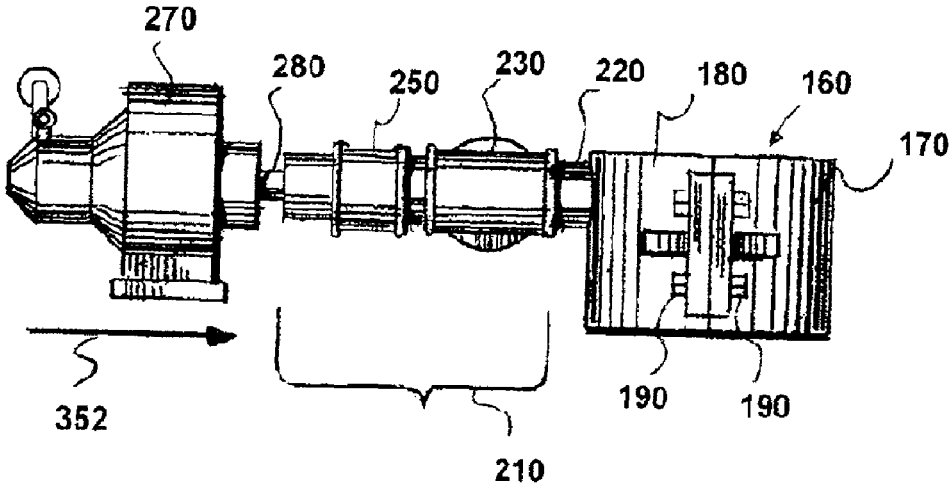
FIG. 5 is a side view of the body of the recovery system in FIG. 3.

FIG. 3 is a perspective view of the recovery system 10 in FIG. 2. Recovery system 10 can be comprised of body 150 and mounting rack 300. FIG. 4 is a perspective view of body 150 of the recovery system 10 in FIG. 3. FIG. 5 is a side view of body 150 of recovery system 10 in FIG. 3.

Body 150 can be comprised of clamp 160, tube 210, and drill 260.

Clamp 160 can be comprised of first portion 170, second portion 180, nipple 220, and a plurality of fasteners 190. Hole 185 can be included in second portion 180. Clamp 160 and hole 185 preferably make a fluid tight seal with casing 20 after an opening in casing 20 is made through hole 185. Clamp 160 can be sized based on the diameter of casing 20 to be drained. Nipple 220 can be attached to second portion 180 and nipple 220 can be threaded. Clamp 160 can also be removably connected to tube 210 (e.g., by a threaded connection with nipple 220) and a plurality of clamps 160 can be included to address different size casings 20. Any conventionally available fastening method can be used in place of fasteners 190. For example, first and second portions 170,180 can be pivotally connected on one side with a locking bracket on the other. However, a plurality of bolted fasteners 190 is preferred to accommodate variations in diameter of casing 20.

Clamp 160 can also include liner 200 which assists in making a fluid tight seal against the surface of casing 20. Liner 170 can be any conventionally available sealing material such as rubber, teflon, cork, paraffin, wax, plastic, metal, polymer, and other sealing materials. Liner 170 is shown covering first and second portions 170,180, however, liner 170 can be placed only on second portion 180 or limited to the area around hole 185, such as a washer or o-ring configuration.

Tube 210 can be connected to clamp 160 and drill 260. Tube 210 can comprise T-connector 230 and coupling 250. Valve 240 can be threadably connected to T-connector 230. Valve 240 can include arm 241 and can be any conventionally available valve such as a ball valve, gate valve, or other commercially available valve. T-connector 230 can be threadably connected to nipple 220. Coupling 250 can comprise a seal (e.g., O-rings 253,254) which sealingly and slidably connects shaft 280 to coupling 250. Coupling 250 can also comprise a lubrication fitting 251, which can be used to lubricate relative movement (longitudinal and rotational) between shaft 280 and tube 210. Guard 312 can be attached to bracket 300 to protect against movement of shaft 280 and motor 270.

Figure 4A:
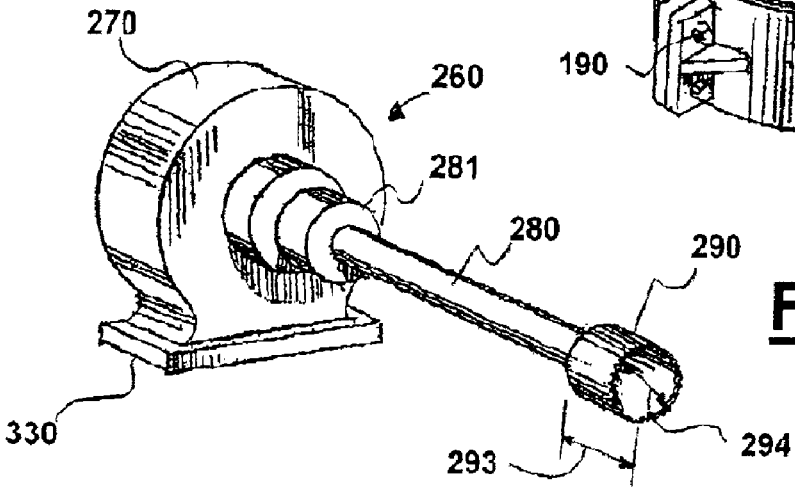
FIG. 4A is a perspective view of the drill used in the recovery system shown in FIG. 3.

FIG. 4A is a perspective view of the drill 260 used in recovery system 10 shown in FIG. 3. Drill 260 can be comprised of motor 270, shaft 280 and drill bit 290 (or hole saw). Motor 270 is preferably pneumatically powered to minimize the risk of explosion. Depth 293 of drill bit 290 (or hole saw) should be sized to at least accommodate the thickness of wall of casing 20 in which an opening is to be made through hole 185. Diameter 294 of drill bit 290 (or hole saw) should be sized to accommodate flow of column 104 of drilling fluid or mud, but also pass through hole 185. Drill bit 290 (or hole saw) can be any conventionally available drill bit and can also include a pilot bit to ease initial drilling of wall of casing 20. It is to be understood that a hole saw is a special type of drill bit.

Figure 7:
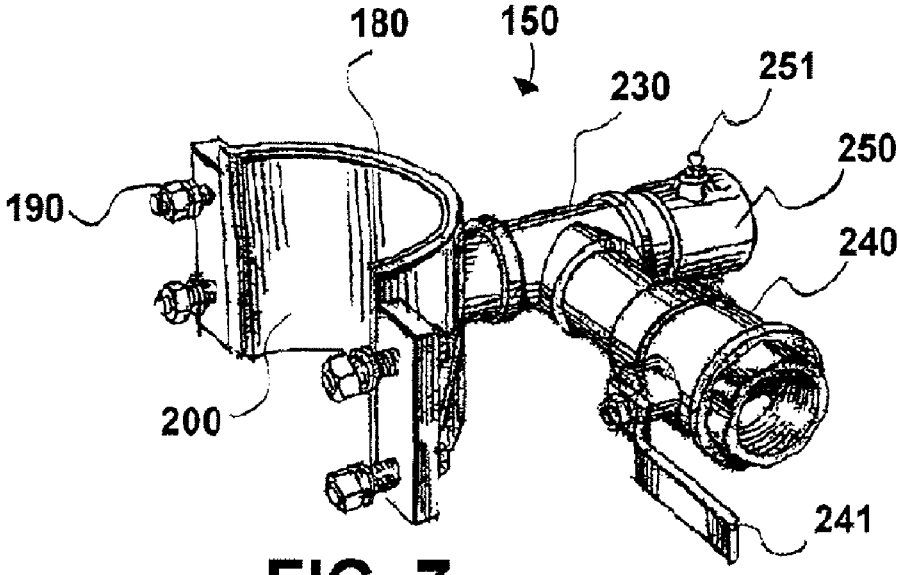
FIG. 7 is a perspective view of a portion of the recovery system in FIG. 2.
Figure 8:
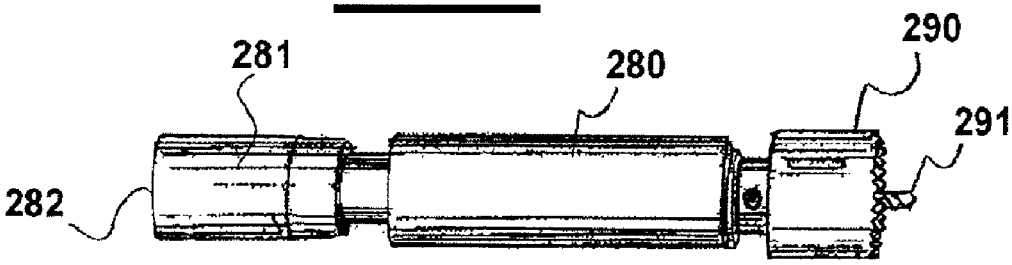
FIG. 8 is a perspective view of a shaft and drill bit for the recovery system in FIG. 2.
Figure 9:
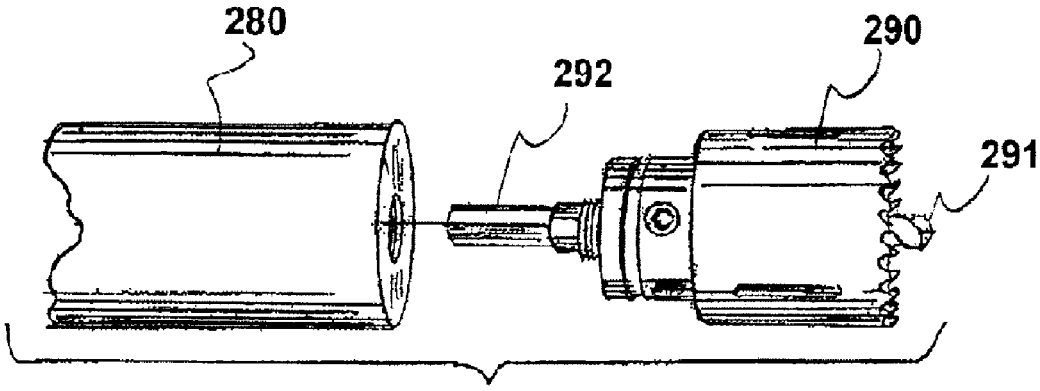
FIG. 9 is an exploded view of the shaft and drill bit for the recovery system in FIG. 2.

FIG. 7 is a perspective view of a portion of body 150 including clamp 160, valve 240, T-connector 230, and coupling 250. Valve 240 can include handle 241 and coupling 250 can include lubrication fitting 251. FIG. 8 is a perspective view of shaft 280 including drill bit 290, and base 281. Drill bit 290 can include pilot drill bit 291 attached to the center of bit 290. Drill bit 290 attaches to shaft 280 and shaft 280 attaches to base 281. Base 281 attaches to motor 270. FIG. 9 is an exploded view of shaft 280 and drill bit 290. Drill bit 290 can include base 292 and base 292 attaches to shaft 280.

Figure 10:
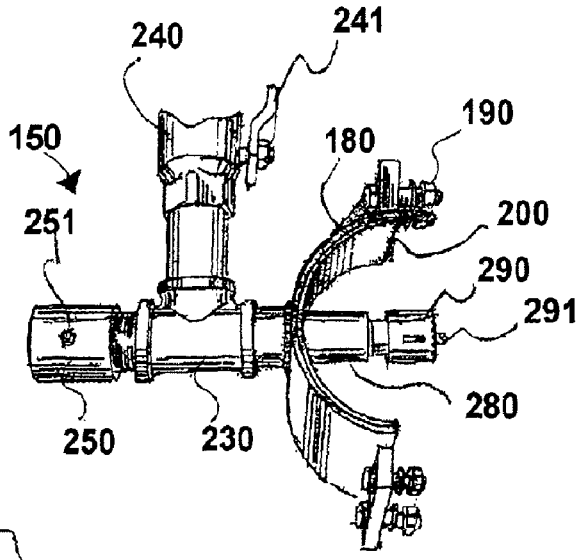
FIG. 10 is a top view of a portion of the recovery system in FIG. 2.
Figure 11:
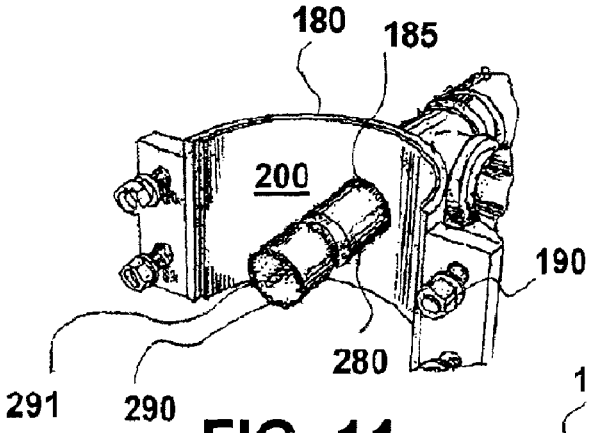
FIG. 11 is a perspective view of a portion of the recovery system in FIG. 2.

FIGS. 10-11 illustrate insertion of drill bit 290 into body 150 through hole 185. FIG. 10 is a top view of a portion of body 150. Shaft 280 is partially inserted into body 150 through hole 185. FIG. 11 is another perspective view of a portion of body 150 with drill shaft 280 partially inserted into body 150 through hole 185.

Figure 12:
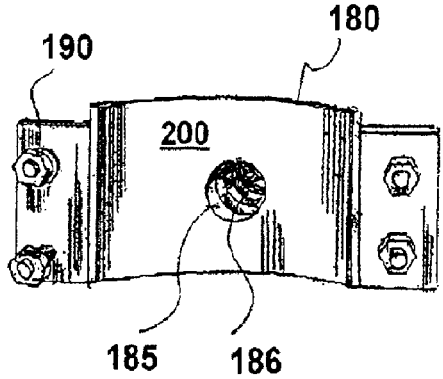
FIG. 12 is a side view of a portion of the clamp of the recovery system in FIG. 2.
Figure 13:
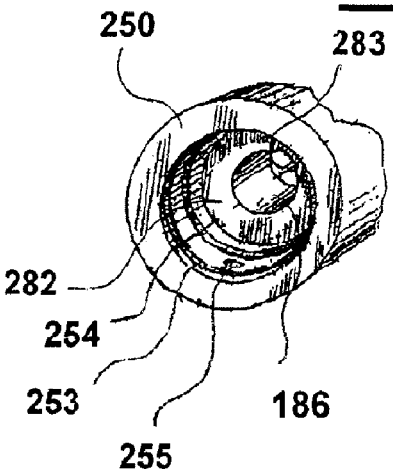
FIG. 13 is an end view of the coupling of the recovery system in FIG. 2.

FIGS. 12-13 illustrate longitudinal passage 186 through body 150. FIG. 12 is a side view of a portion of body 150 showing hole 185 and longitudinal passage 186. Longitudinal passage 186 can extend from hole 185 of section portion 180 through coupling 250 to end 256. T-connector 230 provides an alternative path from passage 186 when valve 240 is in an open position. FIG. 13 is an end view of coupling 250 showing passage 186. O-rings 253,254 can be used to make a fluid tight seal between shaft 280 and coupling 250. Port 255 for lubrication fitting 251 can be used to allow lubrication to be injected between O-rings 253,254 and facilitate rotation/sliding between shaft 280 and O-rings 253,254.

Figure 6:
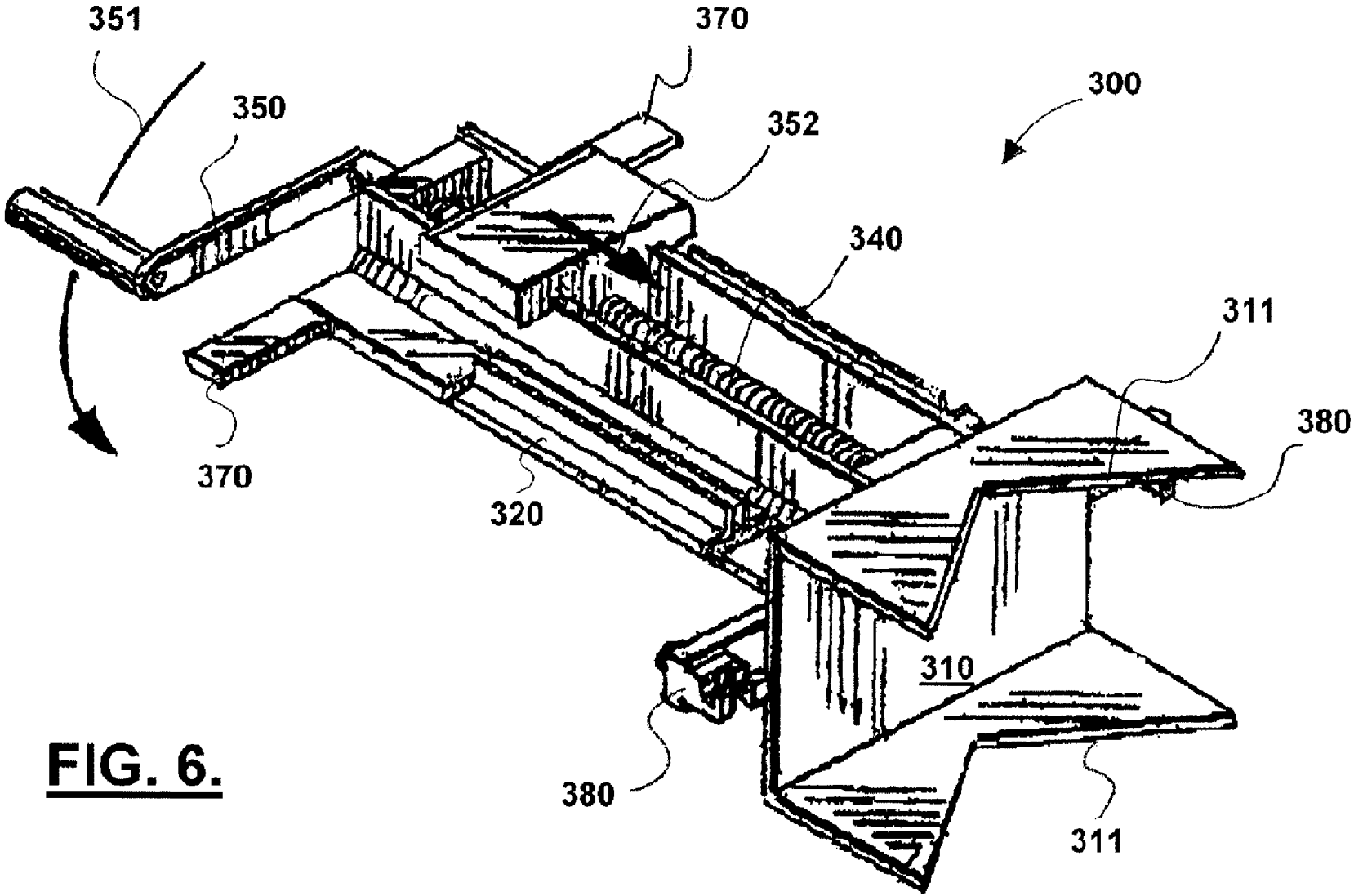
FIG. 6 is a perspective view of the mounting rack for the recovery system in FIG. 3.

FIG. 6 is a perspective view of the mounting rack 300 for the recovery system 10 in FIG. 3. Mounting rack 300 can be comprised of mounting bracket 310, body 320, drive shaft 340, crank 350, and base 330 for motor 270. Mounting bracket 310 can have V-cuts 311 to attach to the wall of casing 20. V-cuts 311 can be triangular or semicircular shaped. Motor 270 can be mounted on base 330. Base 330 can be threadably connected to drive shaft 340 and track along length of body 320. Turning crank 350 in the direction of arrow 351 can move base 330 in a longitudinal direction of arrow 352. Turning crank 350 in the opposite direction can move base 330 in the opposite direction. Connectors 380 and arms 360 can be used with chain 360 (shown in FIG. 2) to mount rack 300 on casing 20.

Before attaching recovery system 10 to casing 20, body 150 is attached to mounting rack 300. Clamp 160 was sized for the particular diameter of casing 20. First portion 170 is removed from clamp 160. Recovery system 10 is placed against casing 20 aligning hole 185 approximately at the location where casing 20 is ultimately to be cut. Mounting bracket 310 is placed against the wall of casing 20. Second portion 180 of clamp 160 should also mount against the wall of casing 20. Chain 360 is wrapped around casing 20, arms 370 and connected to connectors 380. First portion 170 of clamp 160 is attached to second portion 180 via fasteners 190. Liner 200 will make a fluid tight seal with wall of casing 20. Recovery system 10 can then be connected to pump 30 and recovery tank 120 through hoses 134 and 135.

After being connected to casing 20, motor 270 is started which rotates shaft 280 and drill bit 290 in longitudinal passage 186 of body 150. As shown in FIG. 6, crank 351 can be rotated in the direction of arrow 351 causing base 330 and drill 270 to move in the direction of arrow 352. Shaft 280 and drill bit 290, which are both located in longitudinal passage 186, also move in the direction of arrow 352. Drill bit 290 will pass through opening 185 and contact the wall of casing 20. Pilot drill bit 291 will first contact wall of casing 20 making a pilot hole and steadying the drilling by drill bit 290. Drill bit 290 will continue through the wall of casing 20 creating an opening the size of drill bit 290. The portion of the wall of casing 20 which is cut out will be contained in the interior of drill bit 290. Crank 350 is then turned in the opposite direction of arrow 351 causing drill bit 290 move in the opposite direction as arrow 352 and to recess into longitudinal passage 186.

Column of drilling fluid or mud 104 will enter hole 185 and into longitudinal passage 186 of tube 210. O-rings 253,254 sealing contact with shaft 280 will prevent drilling fluid or mud 104 from exiting from coupling 250. Liner 200 prevents spillage of column of drilling fluid or mud 104 from between casing 20 and clamp 160. Instead, flow of column of drilling fluid or mud 104 is directed from longitudinal passage 186 to valve 240 which can be opened via handle 241. Flow will continue through hose 134, pump 130, hose 135 and into receiving tank 120. Pump 130 can be used to greatly increase the flow of column of drilling fluid or mud 104 compared to gravity feed of the column.

After column of drilling fluid or mud is drained, recovery tool 10 is removed from casing 20 and casing 20 is cut using casing cutter 400 creating upper section of casing 30. Upper section of casing 30 is then removed and lower section of casing 40 is prepared for further work related to oil and gas production.

While system 10 is shown as being constructed with most elements located below rig floor 17 where tanks 30 and 40 are conveniently out of the way, fluid recovery system 10 could also contain one or more tanks above the rig floor or positioned as is convenient for rig conditions.

The foregoing disclosure and description of the invention is illustrative and explanatory thereof, and it will be appreciated by those skilled in the art, that various changes in the size, shape and materials, the use of mechanical equivalents, as well as in the details of the illustrated construction or combinations of features of the various elements may be made without departing from the spirit of the invention.

The following is a list of reference numerals:

LIST OF REFERENCE NUMERALS

| (Reference No.) | (Description) |
|---|---|
| 10 | recovery system |
| 20 | casing |
| 30 | upper section of casing |
| 40 | lower section of casing |
| 50 | rig |
| 60 | rig floor |
| 70 | deck |
| 80 | deck |
| 90 | water surface |
| 100 | drilling fluid or mud |
| 104 | column of drilling fluid or mud |
| 105 | drilling fluid or mud |
| 106 | drilling fluid or mud |
| 110 | drilling fluid or mud |
| 120 | recovery tank |
| 130 | pump |
| 134 | hose |
| 135 | hose |
| 150 | body of recovery system |
| 160 | clamp |
| 170 | first portion of clamp |
| 180 | second portion of clamp |
| 185 | hole |
| 186 | longitudinal passage |
| 190 | fasteners |

-continued

LIST OF REFERENCE NUMERALS

| (Reference No.) | (Description) |
|---|---|
| 200 | liner |
| 210 | tube |
| 220 | nipple |
| 230 | T-connector |
| 240 | valve |
| 241 | handle |
| 250 | coupling |
| 251 | lubrication fitting |
| 253 | O-ring |
| 254 | O-ring |
| 255 | port for lubrication fitting |
| 256 | end of coupling |
| 260 | drill |
| 270 | motor |
| 280 | shaft |
| 281 | base |
| 282 | end |
| 283 | keyway |
| 290 | drill bit (or hole saw) |
| 291 | pilot drill bit |
| 292 | base of drill bit |
| 293 | arrow |
| 294 | arrow |
| 300 | mounting rack of recovery system |
| 310 | mounting bracket |
| 311 | V-cut |
| 312 | guard |
| 320 | body |
| 330 | base for motor |
| 340 | drive shaft (which can be threaded) |
| 350 | crank |
| 351 | arrow |
| 352 | arrow |
| 360 | chain |
| 370 | arm |
| 380 | connector |
| 400 | casing cutter |
| 410 | tarpoline |
| 420 | pan |

All measurements disclosed herein are at standard temperature and pressure, at sea level on Earth, unless indicated otherwise. All materials used or intended to be used in a human being are biocompatible, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

What is claimed is:

1. A fluid recovery system for recovering well bore fluid from a joint of casing, comprising:

(a) a body, the body including first and second ends, a longitudinal passage between the first and second ends, and an outlet attached to the body between the first and second ends, the body outlet being fluidly connected to the longitudinal passage;

(b) a clamp, the clamp located at the first end of the body, the clamp being mountable around the joint of casing, the clamp including an opening, the opening being fluidly connected to the longitudinal passage;

(c) a drill, the drill comprising a drill bit, the drill bit being rotatably connected to the drill, the drill bit being insertable into the longitudinal passage;

(d) a rack, the rack comprising a base, the base being movably connected to the rack, the rack being mountable on the joint of casing, the drill being mounted on the base;

(e) wherein the second end of the body is fluidly blocked from the longitudinal passage while the drill bit is located in the longitudinal passage;

(f) wherein movement of the base causes movement of the drill bit while the drill bit is located in the longitudinal passage; and (g) wherein the body further comprises a seal located in the longitudinal passage between the outlet and the second end, the seal sealingly and slidingly connecting the drill bit to the body when the drill bit is located in the longitudinal passage.

2. The fluid recovery system of claim 1, further comprising a tank fluidly connected to the outlet, the tank receiving recovered well bore fluid.

3. The fluid recovery system of claim 2, further comprising a pump fluidly connected to the outlet and tank, the pump pumping recovered well bore fluid.

4. The fluid recovery system of claim 1, further comprising a pneumatic motor operatively connected to the drill.

5. The fluid recovery system of claim 1, wherein the clamp further comprises a seal between the opening and the casing upon which the clamp is mounted.

6. The fluid recovery system of claim 5, wherein the seal comprises a layer of rubber between the clamp and the casing upon which the clamp is mounted.

7. The fluid recovery system of claim 1, wherein the clamp further comprises first and second sections, the first and second sections being connectable by a plurality of fasteners.

8. The fluid recovery system of claim 1, wherein the seal comprises a plurality of spaced apart O-rings, and the body further comprising a lubrication inlet located between at least two of the spaced apart O-rings.

9. The fluid recovery system of claim 1, wherein the base is threadably connected to the rack.

10. A method of recovering well bore fluid from a joint of casing, comprising:

(a) connecting a recovery system on the joint of casing;

(b) the recovery system in step "a" comprising a body, the body including first and second ends, a longitudinal passage between the first and second ends, and an outlet attached to the body between the first and second ends, a pump fluidly connected to the body outlet, the body outlet being fluidly connected to the longitudinal passage; a clamp, the clamp located at the first end of the body, the clamp being mountable around the joint of casing, the clamp including an opening, the opening being fluidly connected to the longitudinal passage; a drill, the drill comprising a drill bit, the drill bit being rotatably connected to the drill, the drill bit being insertable into the longitudinal passage; wherein the second end of the body is fluidly blocked from the longitudinal passage while the drill bit is located in the longitudinal passage, wherein the body further comprises a seal located in the longitudinal passage between the outlet and the second end, the seal sealingly and slidingly connecting the drill bit to the body when the drill bit is located in the longitudinal passage;

(c) drilling a hole in the casing with the drill bit; and (d) using the pump to drain the well bore fluid through the opening and outlet.

11. The method of recovering well bore fluid of claim 10, further comprising the step of pumping the well bore fluid into a recovery tank.

12. The method of recovering well bore fluid of claim 10, wherein in step "c" a pneumatic motor drives the drill.

13. The method of recovering well bore fluid of claim 10, wherein in step "b" the clamp further comprises a seal between the opening and the casing upon which the clamp is mounted and the seal comprises a layer of rubber between the clamp and the casing.

14. The method of recovering well bore fluid of claim 10, further comprising the step of driving the drill with a rack, the drill being mounted on a rack, by rotating a crank, the crank being operatively connected to the rack.

15. The method of recovering well bore fluid of claim 14, further comprising the step of mounting the rack on the joint of casing with a chain.

16. The method of recovering well bore fluid of claim 10, after completion of step "c," further comprising step of opening a valve fluidly connected to the outlet.

17. The method of recovering well bore fluid of claim 10, before completion of step "c," further comprising the step of drilling a pilot hole in the joint of casing using a pilot drill bit.

* * * * *